US007257336B2

(12) United States Patent
Narimatsu et al.

(10) Patent No.: US 7,257,336 B2
(45) Date of Patent: Aug. 14, 2007

(54) DEVELOPING DEVICE, IMAGE FORMING DEVICE EQUIPPED THEREWITH, AND DEVELOPING DENSITY ADJUSTING METHOD

(75) Inventors: Masayasu Narimatsu, Kyoto (JP); Masakatsu Hayashi, Kashiba (JP); Hiroshi Kawamoto, Tenri (JP); Makoto Uehara, Nara (JP); Jitsuo Masuda, Yamatotakada (JP)

(73) Assignee: Sharp Kabushiki Kaisha, Osaka (JP)

( * ) Notice: Subject to any disclaimer, the term of this patent is extended or adjusted under 35 U.S.C. 154(b) by 85 days.

(21) Appl. No.: 11/033,682

(22) Filed: Jan. 13, 2005

(65) Prior Publication Data

US 2005/0152708 A1 Jul. 14, 2005

(30) Foreign Application Priority Data

Jan. 14, 2004 (JP) ..... 2004-006366

(51) Int. Cl.
*G03G 15/08* (2006.01)

(52) U.S. Cl. ..... 399/30; 399/49

(58) Field of Classification Search ..... 399/30, 399/49

See application file for complete search history.

(56) References Cited

U.S. PATENT DOCUMENTS 6,148,161 A 11/2000 Usui et al.
6,442,355 B2 * 8/2002 Hasegawa et al. ..... 399/58
6,501,916 B2 * 12/2002 Suzuki ..... 399/30
7,050,729 B2 * 5/2006 Fujiwara ..... 399/30 X
2006/0152775 A1 7/2006 Itoyama et al.

FOREIGN PATENT DOCUMENTS

| | | | |
|---|---|---|---|
| JP | 05-249788 | | 9/1993 |
| JP | 07-333922 | | 12/1995 |
| JP | 10-123769 | | 5/1998 |
| JP | 11-190933 | A | 7/1999 |
| JP | 2001-013746 | | 1/2001 |
| JP | 2002-82521 | A | 3/2002 |
| JP | 2002-268293 | A | 9/2002 |
| JP | 2002296892 | A * | 10/2002 |
| JP | 2003-316144 | | 11/2003 |

* cited by examiner

*Primary Examiner*—David M. Gray
*Assistant Examiner*—Erika J. Villaluna
(74) *Attorney, Agent, or Firm*—Birch, Stewart, Kolasch & Birch, LLP

(57) ABSTRACT

In case of a developing density correction based on a test image (patch image) density, normally, the developing density is carried out in a short period of time by correction (γ correction) of a developing bias and a grid voltage (S11). When a correction amount of the γ correction exceeds an ordinary range, the γ correction (S11) and adjustment of toner concentration (magnetic permeability reference value) (S5) are carried out in combination. Furthermore, when the toner concentration is changed, the setting of a correction reference of the γ correction (γ correction TBL) and correction timing of the γ correction are accordingly changed (S6, S7). Therefore, in the developing density correction based on the test image density in the developing device using binary developer, it is possible to carry out the developing density correction, which is carried out in a short time, and whose correction width is wide, while maintaining the accuracy of a developing density adjustment.

9 Claims, 6 Drawing Sheets

DEVELOPING DEVICE, IMAGE FORMING DEVICE EQUIPPED THEREWITH, AND DEVELOPING DENSITY ADJUSTING METHOD

This Nonprovisional application claims priority under 35 U.S.C. § 119(a) on Patent Application No. 2004/6366 filed in Japan on Jan. 14, 2004, the entire contents of which are hereby incorporated by reference.

FIELD OF THE INVENTION

The present invention relates to a developing device which develops, by using toner, an electrostatic latent image formed on an image carrier, and also relates to an image forming device equipped with the developing device, and a developing density adjusting method.

BACKGROUND OF THE INVENTION

According to an image forming device using an electrophotographic printing method, a developing device develops an electrostatic latent image formed on a photoreceptor drum (image carrier). The developing device includes (i) a developing roller, which faces with the photoreceptor drum (image carrier), and (ii) a developer tank containing developer. The photoreceptor drum (image carrier) is rotatable. The electrostatic latent image is formed on the photoreceptor drum (image carrier). The developing roller rotates in order to deliver the developer from the developer tank to the photoreceptor drum, in order to develop the electrostatic latent image formed on the photoreceptor drum.

The density of the image developed by the developing device fluctuates according to various factors, so that it is necessary to adjust the density in order to maintain constant image quality.

Conventionally, in the developing device, a density adjustment is generally carried out as follows: (i) a criterial patch image (test image) is developed to (is formed on) the photoreceptor drum, a transfer belt, or the like, and then density of the patch image is detected, and (ii) γ correction is carried out according to the difference between the density detected and a predetermined reference density. In the γ correction, a developing bias (a bias potential of the developing roller) and a potential charged on the photoreceptor drum (a grid voltage of a charging device) are adjusted. In this case, a conversion table is looked up for finding (setting) a correction amount corresponding to a detected patch image density. The conversion table is prepared beforehand based on experimental data, or the like, and is used to convert the patch image density to the correction amount (hereinafter referred to as a developing density correction amount) of the developing bias, the grid voltage, and the like (that is, to find appropriate developing density correction amount of the developing bias, the grid voltage, and the like according to patch image density).

Moreover, in cases where the developer is a binary developer including the toner and carriers, the carriers are left inside the developer tank, and only the toner is used and consumed for the development. The amount of the toner consumed is replenished to the developer tank by toner supplying means.

In the developing device using the binary developer, in order to maintain the image quality, it is necessary to maintain the concentration of the toner in the developer tank to be an appropriate density. On this account, the developing device using the binary developer is generally arranged such that (i) the magnetic permeability of the developer is measured as an index of the toner concentration, and (ii) when a magnetic permeability detection value (detection signal level) exceeds a reference value for a toner supply judgment, the toner concentration is considered to be less than a predetermined value, then the toner is supplied.

Incidentally, in the above-mentioned density adjustment, when the developing bias is too large or the grid voltage is too small, a cleaning field (potential difference between the photoreceptor drum and the developing roller) becomes too small. The problem here is that an image would be developed such that the image is developed also in a portion where no image should be developed (This problem is called "fogging"). On the contrary, when the developing bias is too small or the grid voltage is too large, the cleaning field becomes too large. The problem here is that the carriers of the developer are transported (dropped) onto the photoreceptor drum, or abnormal electrical discharge (pinhole leak) occurs. In some cases, the carriers transported onto the photoreceptor drum would be rubbed by a cleaning blade. This would possibly cause a damage on the photoreceptor drum. On this account, there is a limit to the developing density correction carried out by adjusting the developing bias and the grid voltage.

Conventionally, for example, Japanese Laid-Open Patent Publication No. 190993/1999 (Tokukaihei 11-190933, published on Jul. 13, 1999) describes means of adjusting the developing density: in cases where an output correction amount (grid correction amount) of a charging apparatus (charging device) is equal to or more than a predetermined value, a toner concentration reference value (which corresponds to the magnetic permeability reference value) is changed accordingly. That is, the above publication discloses such an arrangement that, in cases where a correction width of the grid voltage according to the density of the patch image is equal to or more than a predetermined width, the reference density of the developer (that is, the toner concentration) is increased or decreased accordingly. According to the method in the above publication, it is possible to prevent a fog phenomenon and the transport of the carrier to the drum, and also possible to widen a correction range of the developing density. In this way, it is possible to maintain constant image quality for a long time while coping with various situations.

However, different ideal conversion tables for conversion from the patch image density to the developing density correction amount, that is, different correction references of the developing density are required by different developing density. On this account, the technique described in Japanese Laid-Open Patent Publication No. 190933/1999 faces following problem: in cases where the magnetic permeability reference value is changed from a normal reference value (that is, the magnetic permeability reference value corresponding to the conversion table), it is impossible to set the developing density correction amount appropriately, so that the accuracy of the developing density adjustment is deteriorated.

Meanwhile, instead of adjusting the magnetic permeability reference value according to the output correction amount of the charging apparatus, it is possible to arrange such that the magnetic permeability reference value is adjusted according to the toner concentration, that is, according to the patch image density. However, because the developer tank containing the developer has a fixed capacity, it takes time to attain the uniform toner concentration in the entire developer tank by stirring the developer after the toner supply. On this account, the problem here is that developing density correction performed by adjusting the magnetic permeability reference value according to the patch image density requires a long time each time it is carried out.

SUMMARY OF THE INVENTION

An object of the present invention is to provide a developing device, which uses the binary developer and makes it possible to carry out the developing density correction which is based on a test image density and is carried out in a short time, and whose correction width is wide, while maintaining the accuracy of the developing density adjustment. Another object of the present invention is to provide an image forming device equipped with the developing device, and a developing density adjusting method.

To achieve the above objects, the developing device of the present invention includes (a) a magnetic permeability detecting section for detecting magnetic permeability of developer containing toner and carriers in order to obtain a magnetic permeability detection value, (b) a toner supplying section for supplying the toner according to comparison of the magnetic permeability detection value and a magnetic permeability reference value, (c) a developing section for developing, by using the toner, an electrostatic latent image formed on an image carrier; and (d) a developing density correcting section for correcting a developing density by correcting, according to the density of a test image formed by using the developing section, a developing bias of the developing section and/or a potential charged on the image carrier, and the developing device further includes a magnetic permeability reference value adjusting section for adjusting the magnetic permeability reference value in cases where a correction amount by the developing density correcting section exceeds a predetermined range; and a developing density correction reference setting section for setting a correction reference of the developing density in the developing density correcting section according to the magnetic permeability reference value thus adjusted.

Therefore, in the developing density correction based on the test image density, normally, it is possible to correct the developing density in a short period of time by the correction (γ correction) of the developing bias and the grid voltage (the potential charged on the image carrier). Moreover, by combining the γ correction with the adjustment of the toner concentration (that is, the adjustment of the magnetic permeability reference value), it is possible to attain the developing density correction which has a wide correction range. Furthermore, in cases where the toner concentration (that is, the magnetic permeability reference value) is changed (adjusted), the setting of the correction reference (the conversion table, a conversion formula, etc. for conversion from the test image density to the correction amount) of the γ correction is accordingly changed. Therefore, it is possible to assure the accuracy of the γ correction.

Moreover, to achieve the above objects, the developing density adjusting method of the present invention includes the steps of (i) detecting magnetic permeability of developer containing toner and carriers in order to obtain a magnetic permeability detection value, (ii) supplying the toner according to comparison of the magnetic permeability detection value and a magnetic permeability reference value, (iii) developing, by using the toner, an electrostatic latent image formed on an image carrier, (iv) correcting a developing density of development in step (iii) according to the density of a test image, and the developing density adjusting method further includes the steps of (v) adjusting the magnetic permeability reference value according to a correction amount in step (iv), and (vi) adjusting a correction reference of the developing density in step (iv) according to the magnetic permeability reference value.

Additional objects, features, and strengths of the present invention will be made clear by the description below. Further, the advantages of the present invention will be evident from the following explanation in reference to the drawings.

BRIEF DESCRIPTION OF THE DRAWINGS

FIG. 4(*b*) is a graph illustrating a relation between an elapsed time from starting an operation and the electrical-charge amount of the developer.

FIG. 5(*b*) is a graph illustrating a relation between the elapsed time from starting the operation and the output value from the magnetic permeability sensor for the developer.

FIG. 6(*b*) is a graph illustrating a relation between toner concentration and the magnetic permeability of the developer.

DESCRIPTION OF THE EMBODIMENTS

The following description explains one embodiment of the present invention in reference to the figures. The following embodiment is one concrete example of the present invention, and does not limit the technical scope of the present invention.

Figure 1:
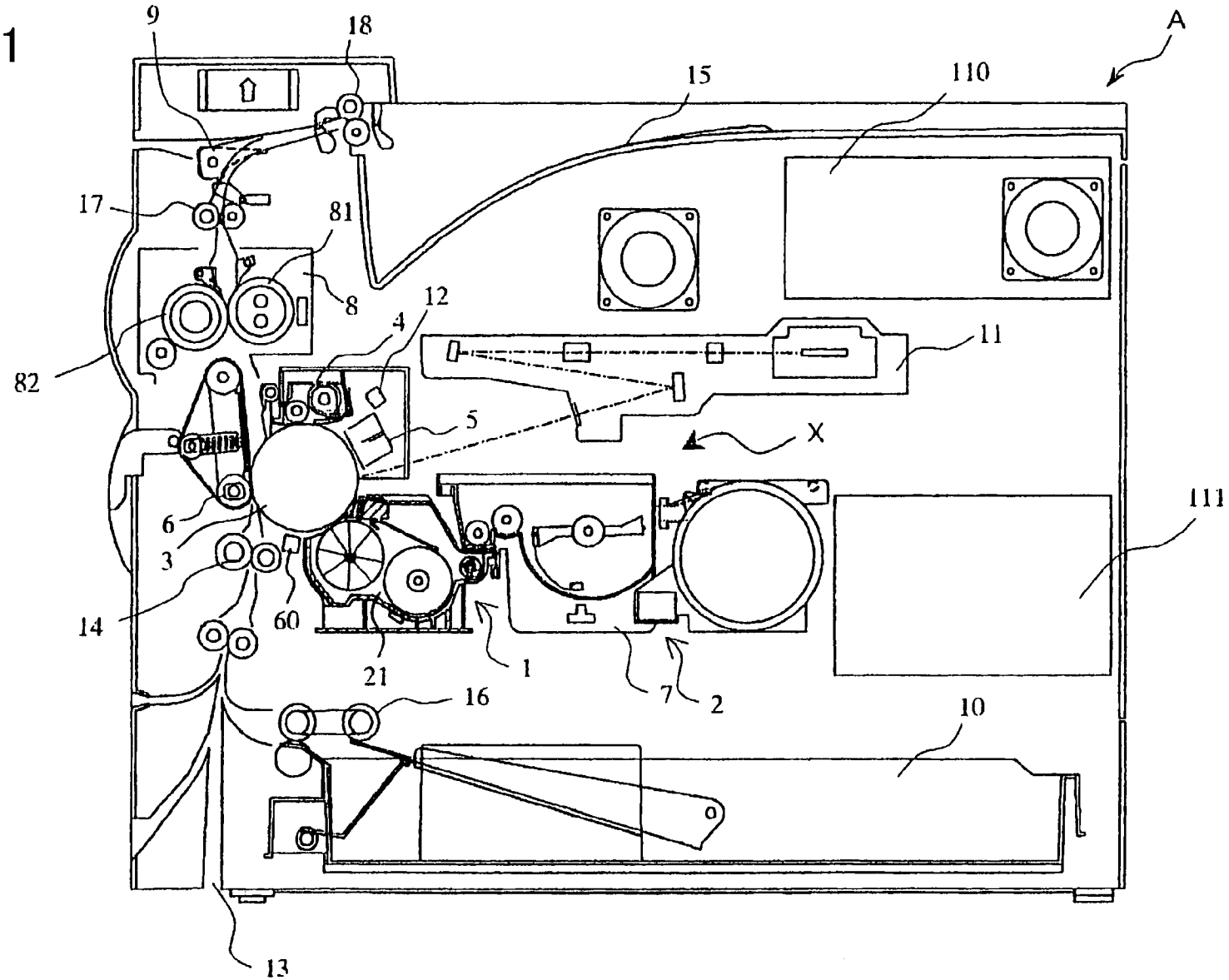
FIG. 1 is a schematic cross-sectional view of an image forming device A equipped with a developing device X according to an embodiment of the present invention.
Figure 2:
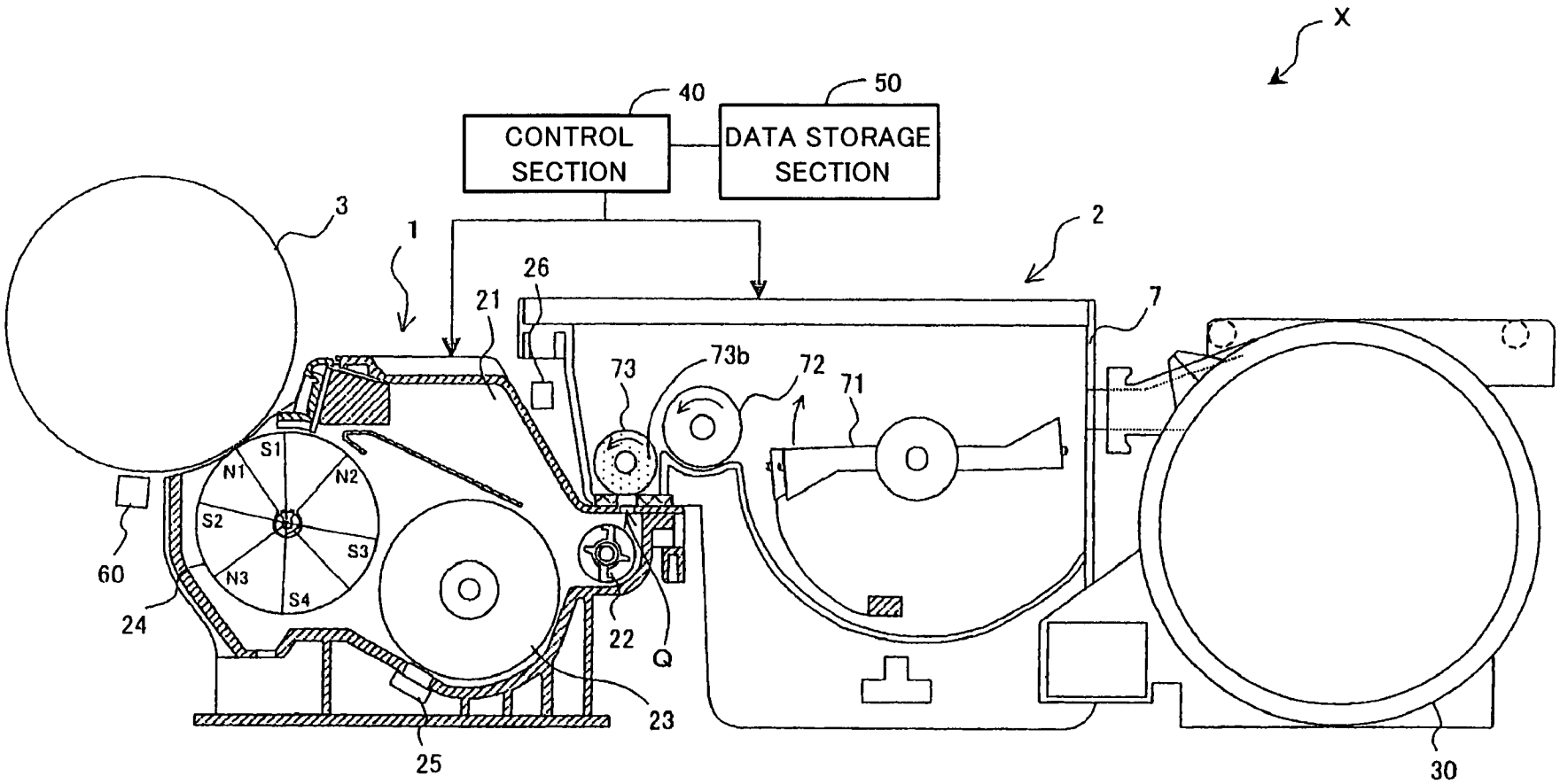
FIG. 2 is a schematic cross-sectional view of the developing device X.
Figure 3:
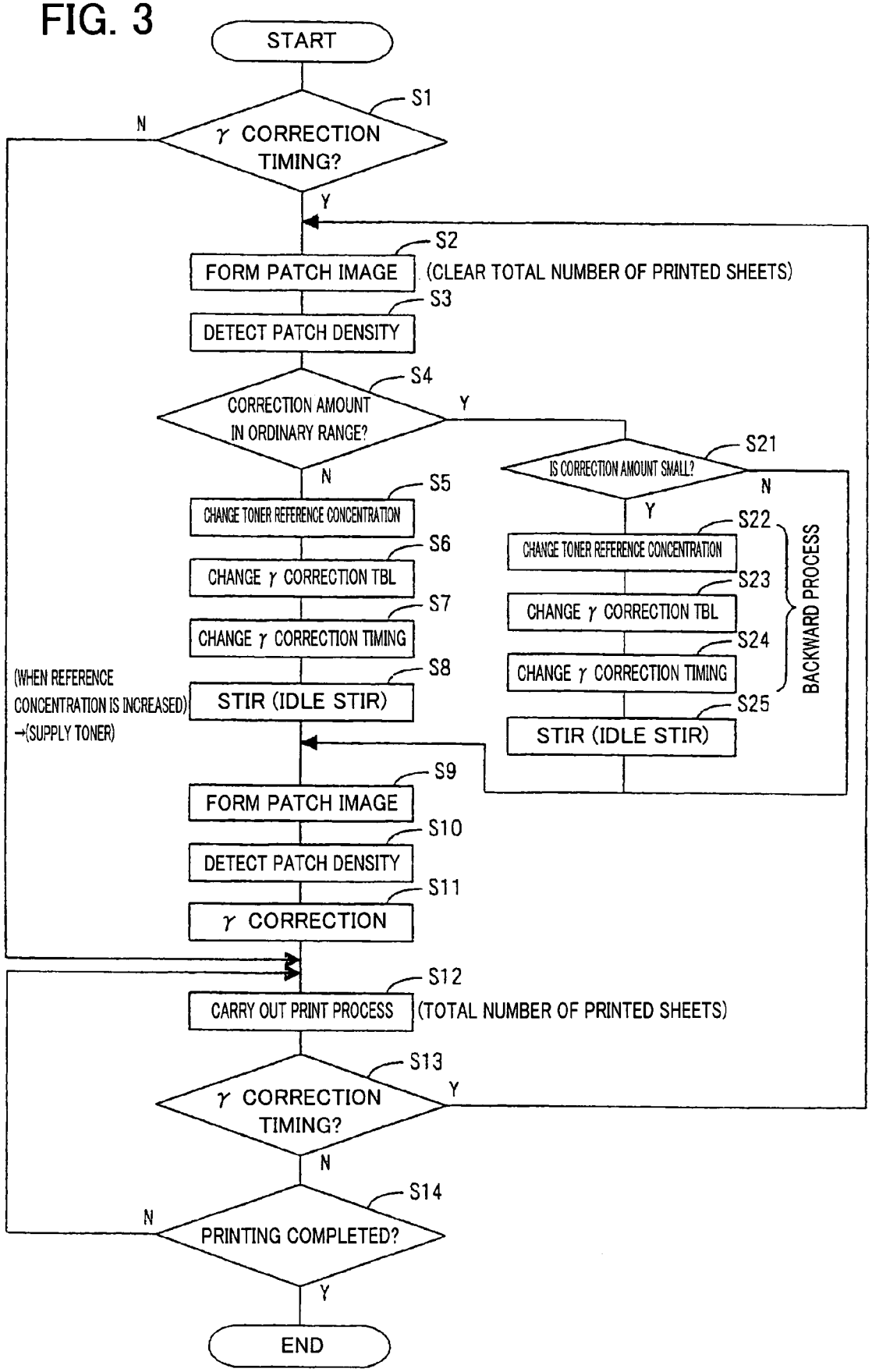
FIG. 3 is a flow chart illustrating steps of a developing density adjustment process by the developing device X.
Figure 4:
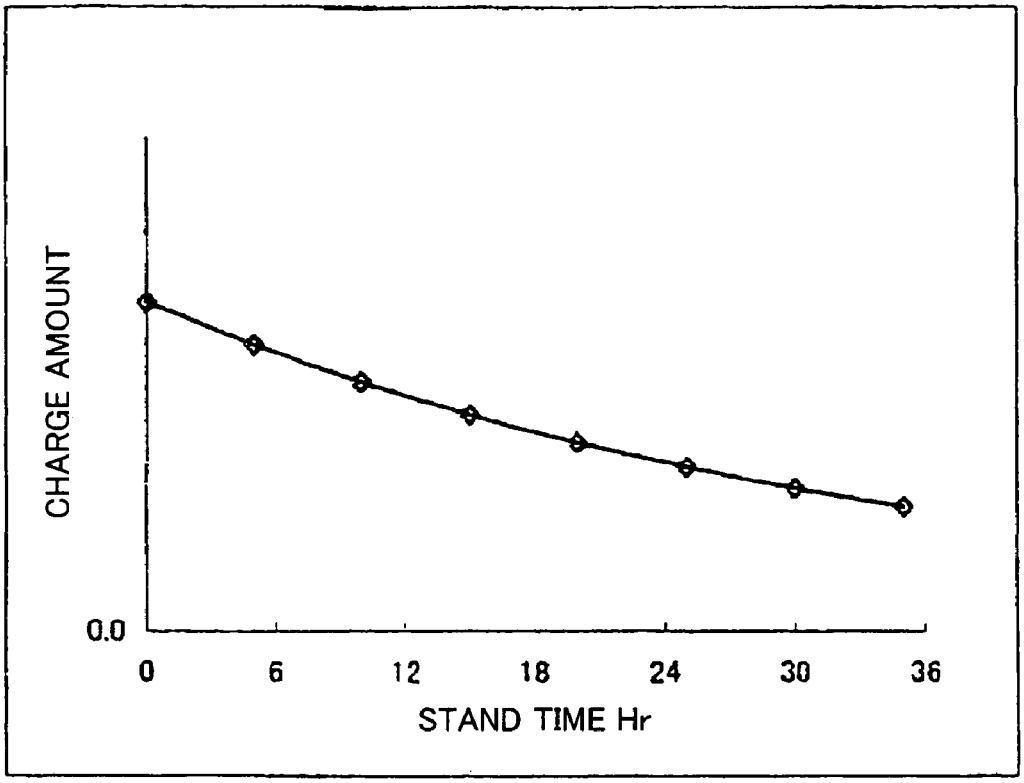
FIG. 4(*a*) is a graph illustrating a relation between a stand time and an electrical-charge amount of developer.
Figure 4:
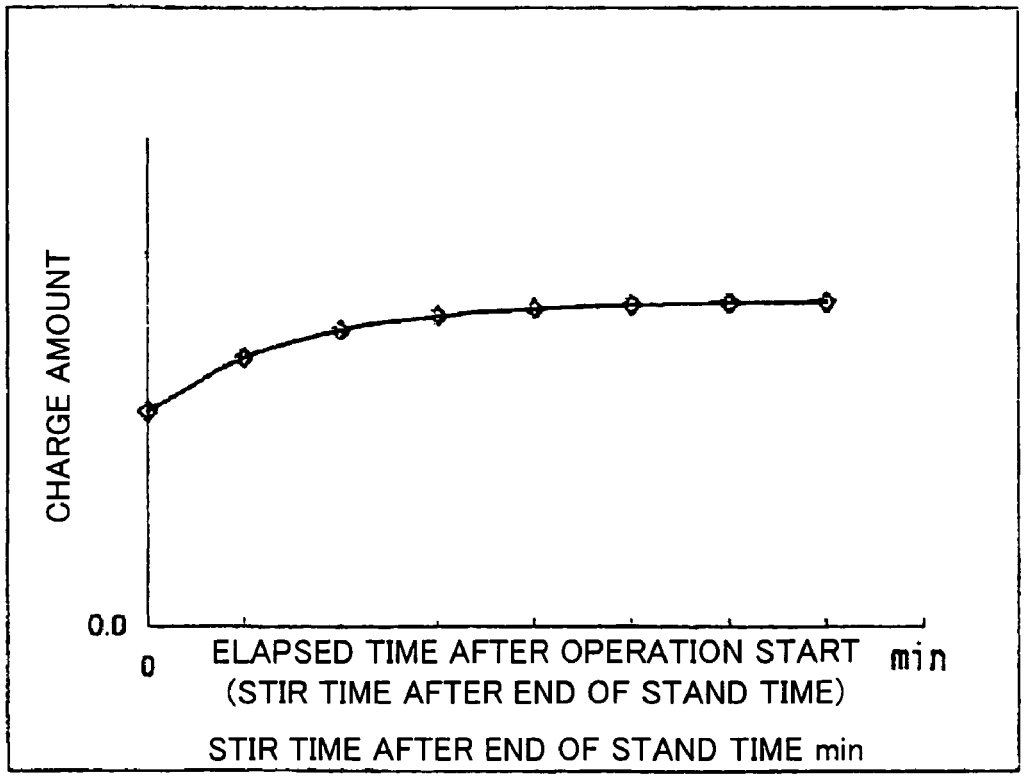
Figure 5:
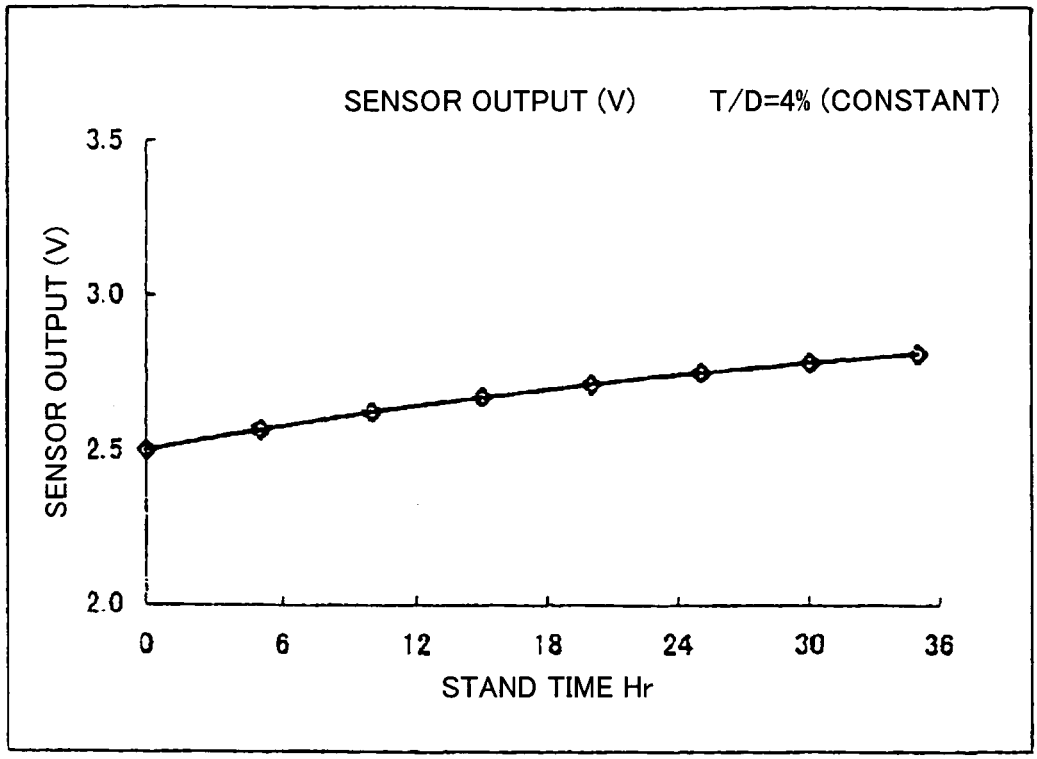
FIG. 5(*a*) is a graph illustrating a relation between the stand time and an output value from a magnetic permeability sensor for the developer.
Figure 5:
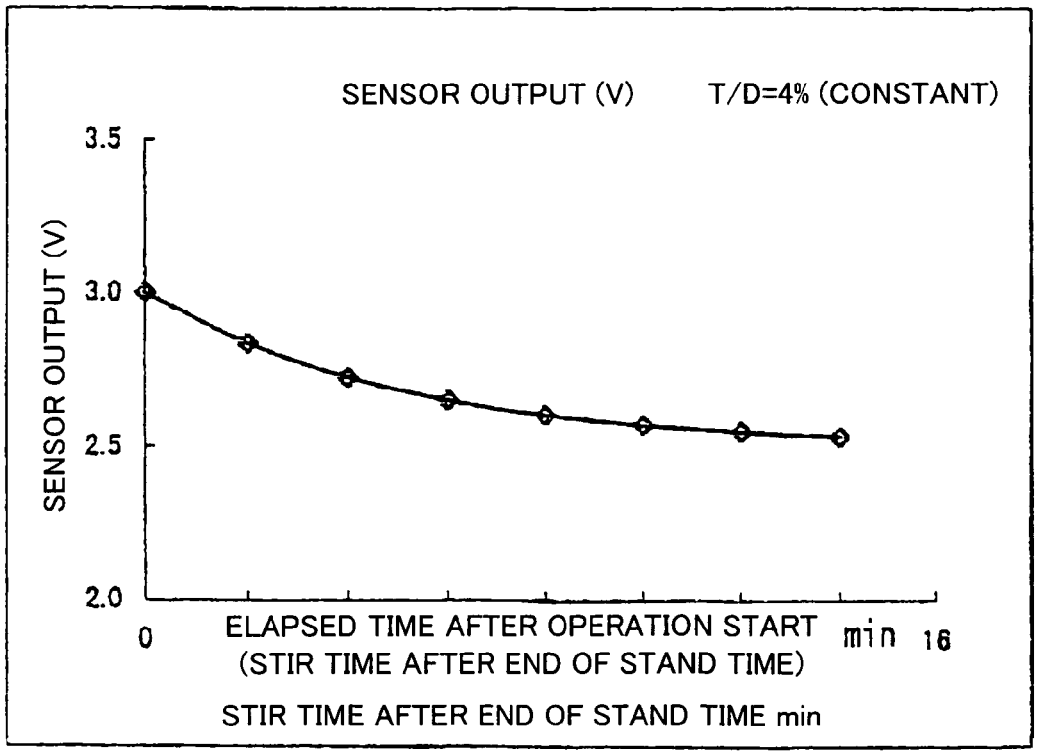
Figure 6:
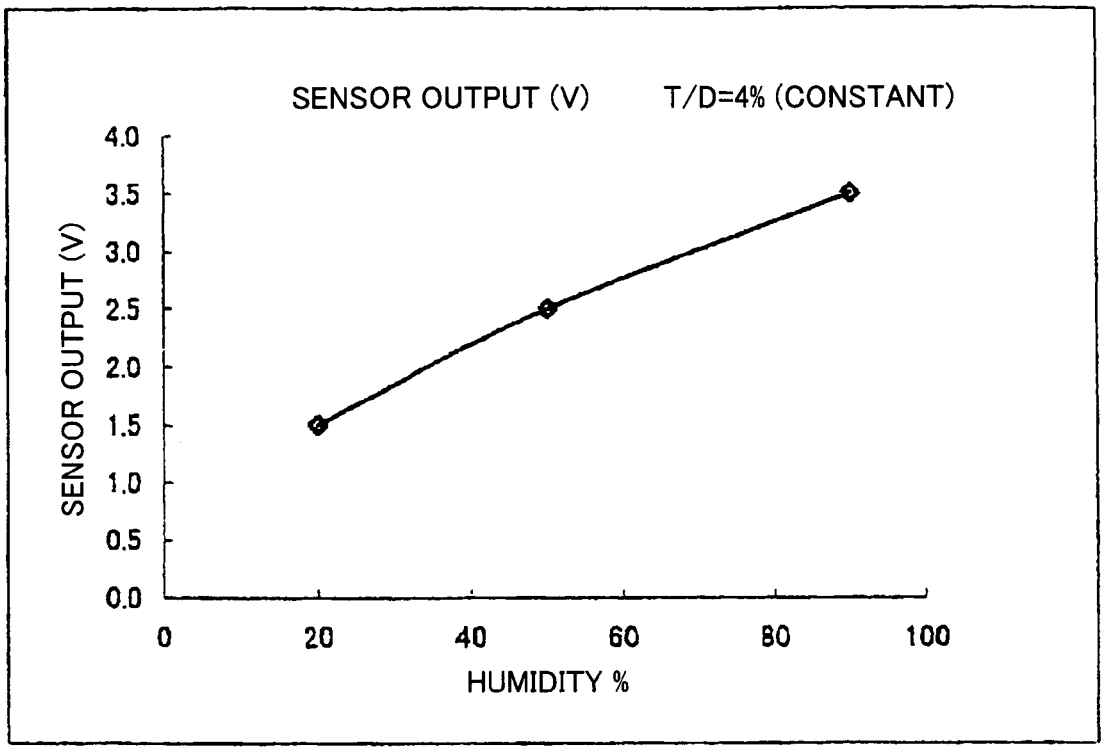
FIG. 6(*a*) is a graph illustrating a relation between humidity and magnetic permeability of the developer.
Figure 6:
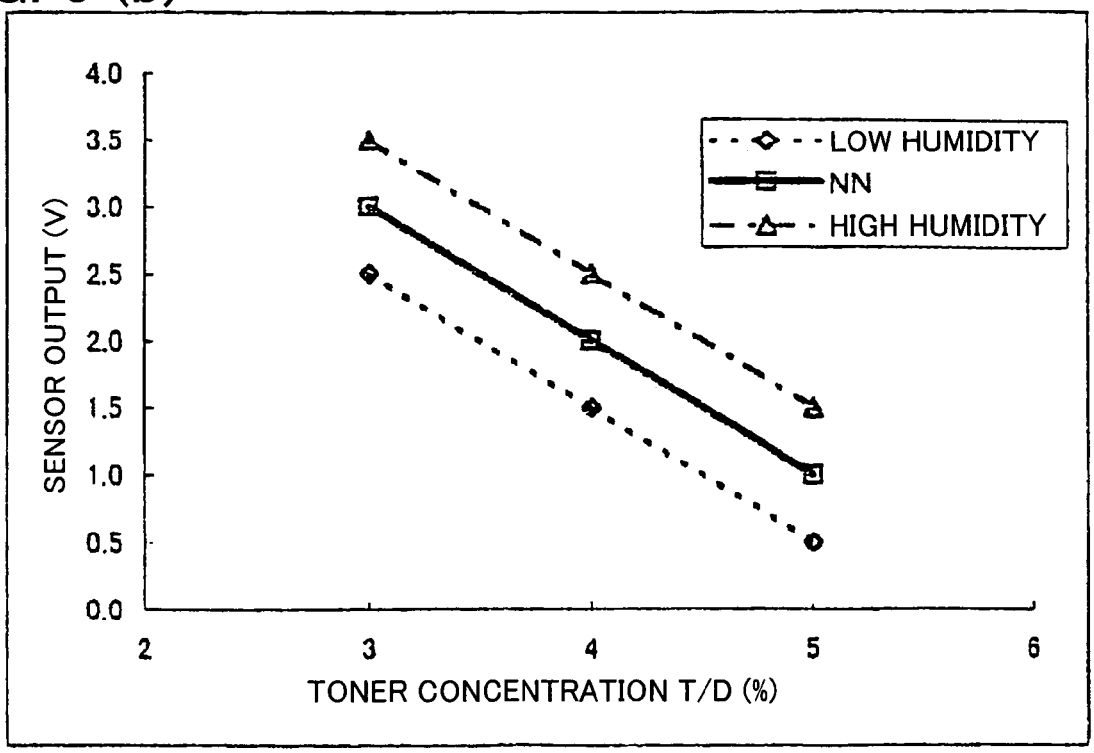

FIG. 1 is a schematic cross-sectional view of an image forming device A equipped with a developing device X according to the present embodiment. FIG. 2 is a schematic cross-sectional view of the developing device X. FIG. 3 is a flow chart illustrating steps of a developing density adjustment process of the developing device X. FIG. 4(*a*) is a graph illustrating a relation between a stand time and an electrical-charge amount of the developer. FIG. 4(*b*) is a graph illustrating a relation between an elapsed time from starting an operation and the electrical-charge amount of the developer. FIG. 5(*a*) is a graph illustrating a relation between the stand time and an output value from a magnetic permeability sensor for the developer. FIG. 5(*b*) is a graph illustrating a relation between the elapsed time after starting the operation and the output value from the magnetic permeability sensor for the developer. FIG. 6(*a*) is a graph illustrating a relation between humidity and magnetic permeability of the developer. FIG. 6(*b*) is a graph illustrating a relation between toner concentration and the magnetic permeability of the developer.

The following description explains an arrangement of the image forming device A equipped with the developing device X according to the embodiment of the present invention in reference to the cross-sectional view of FIG. 1.

The image forming device A is a printer which outputs an image by using the electrophotographic printing method, in order that the image is recorded (on a recording medium). The image to be outputted by the image forming device A are (i) an image prepared from a scanned image obtained by using an image scanner and (ii) an image prepared from data from an external device (a host device such as a personal computer) connected to the image forming device A.

The image forming device A has an image forming section provided with a photoreceptor drum 3 and process units provided around the photoreceptor drum 3, the process units carrying out respective functions of an image forming process. Around the photoreceptor drum 3, charging (electrifying, electrically charging) means 5, a light scanning unit 11, the developing device X, transfer means 6, a cleaning unit 4, a charge-removing lamp 12, and the like are provided in this order.

The charging means 5 uniformly charges the surface of the photoreceptor drum 3. The light scanning unit 11 writes an electrostatic latent image on the photoreceptor drum 3 by scanning the thus uniformly charged photoreceptor drum 3. Further, the electrostatic latent image, which is written on the photoreceptor drum 3 (one example of the image carrier) by the light scanning unit 11, is developed (visualized) with toner by a developing section 1 (one example of developing means) of the developing device X. A toner supplying section 2 in the developing device X supplies the toner from a toner supply tank 7 to a developer tank 21, so that a consumed amount of the toner is replenished.

Next, the transfer means 6 transfers, onto a recording sheet, the image, which is visualized on the photoreceptor drum 3. Further, the cleaning unit 4 removes the developer remained on the photoreceptor drum 3, so that it becomes possible to record a new image onto the photoreceptor drum 3. Moreover, the charge-removing lamp 12 removes charge on the surface of the photoreceptor drum 3.

At a lower part of the image forming device A, a supply tray 10 is provided inside the image forming device A. The supply tray 10 is a recording material storage tray for storing recording sheets therein. The recording sheets stored in the supply tray 10 are separated one by one by a pickup roller 16 or the like, and are delivered to a resist roller 14 one by one. After the resist roller 14 takes the timing of supplying the recording sheet for the image formed on the photoreceptor drum 3, the recording sheets are sequentially supplied to a space between transfer means 6 and the photoreceptor drum 3. Then, the image recorded on the photoreceptor drum 3 is transferred onto the recording sheet. Note that, in order to supply the recording sheets to the supply tray 10, the supply tray 10 needs to be drawn to a front side (an operation side, a near side of the figure).

On an under surface of the image forming device A, a sheet receiving entrance 13 is provided. The sheet receiving entrance 13 receives the recording sheets sent from a desk device (not illustrated), a large capacity recording material supplying device (not illustrated), or the like. The desk device is provided as a peripheral device and has a plurality of recording sheet supplying trays. The large capacity recording material supplying device can store a lot of the recording sheets therein. The sheet receiving entrance 13 sequentially supplies the recording sheets to the image forming section.

At an upper part of the image forming device A, a fixing device 8 including a fixing roller 81 and a pressing roller 82 is provided. The fixing device 8 sequentially receives the recording sheets on each of which the image is transferred, and fixes, with heat and pressure, the thus transferred image on the recording sheet. In this way, the image is recorded on the recording sheet.

The recording sheet on which the image is recorded is delivered upward by a delivery roller 17, and passes through a switch gate 9. Then, in cases where an onboard tray 15 provided as a peripheral member of the image forming device A is designated as a tray to which the recording sheets are outputted (delivered out), the recording sheets are outputted to the onboard tray 15 by reverse rollers 18. Meanwhile, in cases where a double-sided image formation or a postprocessing needs to be carried out, the reverse rollers 18 cause part of a recording sheet to be out into the onboard tray 15, and stops as such so that the reverse rollers 18 sandwiches the rear end of the recording sheet. Then, the reverse rollers 18 are rotated reversely to deliver the recording sheet in a reverse direction (reverse transport), that is, in a direction toward a recording material resupply delivery device or a postprocessing device, both of which are optionally provided for the double-sided image formation or for the postprocessing.

At this moment, the switch gate 9 changes its position from a position illustrated by a solid line in FIG. 1 to a position illustrated by a dotted line in FIG. 1. In case of carrying out the double-sided image formation, the reserve transportation passes the recording sheet through the recording material resupply delivery device (not illustrated) and supplies it again to the image forming device A. In case of carrying out the postprocessing, the recording sheet is delivered from the recording material resupply delivery device to the postprocessing device through a relay delivery device (not illustrated) by another switch gate. Then, the postprocessing is carried out. FIG. 1 is an example of the image forming device in which the recording material resupply delivery device and the postprocessing device are not provided.

In spaces above and below the light scanning unit 11, a control section 110, a power unit 111, and the like are provided. The control section 110 contains a circuit substrate which controls the image forming process, an interface substrate which receives image data from an external device, and so on. The power unit 111 supplies electric power to the interface substrate and each of sections for the image formation.

FIG. 2 is a cross-sectional view illustrating a schematic arrangement of the developing device X according to the embodiment of the present invention. The developing device X uses a developer composed of toner and carriers (binary developer).

Roughly speaking, the developing device X is composed of a developing section 1 and a toner supplying section 2.

The developing section 1 includes (i) a developing roller 24, which faces with the photoreceptor drum 3, (ii) a developer tank 21 containing the developer, (iii) a stir rotating blade 22 provided for stirring the developer in the developer tank 21, and (iv) a stirring roller 23. The photoreceptor drum 3 is rotatable. The electrostatic latent image is formed on the photoreceptor drum 3. The developing roller 24 rotates in order to deliver the developer from the developer tank 21 to the photoreceptor drum 3, in order to develop the electrostatic latent image formed on the photoreceptor drum 3.

The developer in the developer tank 21 is stirred and electrified by the rotation of the developing roller 24, the stir rotating blade 22, and the stirring roller 23. Further, to the developing roller 24, a developing bias voltage is applied in order to cause a potential difference between to the developing roller 24 and the photoreceptor drum 3.

The developing device X further includes (i) a magnetic permeability sensor 25 (one example of magnetic permeability detecting means) which measures the magnetic permeability of the binary developer (the developer containing the toner and the carriers) in the developer tank 21, (ii) a humidity sensor 26 which measures the humidity (environmental humidity) of the surrounding air around the developing device X. Values measured by these sensors show the toner concentration of the developer and the humidity of the surrounding air, respectively.

Moreover, the toner supplying section 2 in the developing device X includes (i) a toner supply tank 7 which contains the toner to be supplied to the developer tank 21, (ii) a paddle 71 which is provided inside the toner supply tank 7 and rotates so as to transport the developer in an upper direction, (iii) a toner delivery roller 72 which delivers the toner having been transported upward by the paddle 71, and (iv) a toner supply roller 73 which supplies the toner, which is delivered from the toner delivery roller 72, to the developer tank 21 through an inlet Q.

A magnetic permeability detection value (toner concentration) measured by the magnetic permeability sensor 25 is compared with a reference value $V_{ref}$ (the magnetic permeability reference value) that is for use in deciding whether or not the replenishment of the toner is necessary. In the toner supplying section 2 (one example of toner supplying means), the toner supply roller 73 rotates when the magnetic permeability detection value is equal to or more than the reference value $V_{ref}$ (that is, the toner concentration is low in the developer) whereas the toner supply roller 73 stops when the magnetic permeability detection value is equal to or less than $V_{ref}-\beta$ (where $\beta>0$). In this way, the toner is intermittently supplied to the developer tank 21.

To the toner supply tank 7, a toner bottle 30 filled with the toner is attached. The toner bottle 30 supplies the toner to the toner supply tank 7 according to need.

A control section 40 performs operation controls (startup, shutdown, driving control of the toner supply roller 73 according to the toner concentration (magnetic permeability detection value), and the like) of the developing device X including the toner supplying section 2. The control section 40 includes a CPU, a ROM and other peripheral devices. In the ROM, a program to be executed by the CPU is stored. The CPU executes the program stored in the ROM, so that the following processes are carried out. The control section 40 further includes a clock generator, by which elapsed time can be measured.

The developing device X further includes a data storage section 50 composed of a SRAM and/or the like. The SRAM stores various parameters and formulas (a coefficient of a formula, etc) used for the process of the control section 40.

Next, in reference to the flow chart of FIG. 3, the following description explains the steps of the developing density adjustment process by the developing device X. The developing density adjustment process is performed by execution of a control program by the control section 40. S1, S2, and the like represent process steps (steps).

<Step S1>

When print data is received from the host device, the control section 40 judges whether or not a γ correction timing (time for γ correction) has come yet. The γ correction is a process of correcting one of or both of a developing bias of the developing section 1 and a potential charged on the photoreceptor drum 3. The γ correction is carried out in below-mentioned Step S11.

This judgment is carried out as follows: for example, in cases where the total number of printed sheets (the total (accumulated) number of recording papers to which images have been formed so far after previous correction) is equal to or more than a predetermined number of sheets set for a judgment of the γ correction timing (hereinafter, this predetermined number of sheets is referred to as a predetermined γ correction sheet number), the control section 40 judges Yes to the γ correction timing (that is, the control section 40 judges that the γ correction timing has come). Note that, the total number of printed sheets and the predetermined γ correction sheet number are stored in the data storage section 50.

When the control section 40 judges Yes to the γ correction timing, the next step is Step S2. When the control section 40 judges No to the γ correction timing (that is, the control section 40 judges that the γ correction timing has not come yet), the next step is Step S12.

<Step S2, Step S3>

When the control section 40 judges Yes to the γ correction timing, the control section 40 functions so that the developing section 1 (developing means) forms (develops) a predetermined patch image (one example of the test image) on the photoreceptor drum 3 (S2). At this moment, the total number of printed sheets is cleared (initialized).

The control section 40 further causes a reflection-type image density sensor 60 (image density detecting means) to measure density (image density) of the patch image (S3). Note that, the reflection-type image density sensor 60 is provided with an illumination lamp and a CCD (Charge Coupled Device) which performs photo-electro conversion of the reflection light of the illumination lamp. As illustrated in FIG. 2, the image density sensor 60 is provided, for example, around the photoreceptor drum 3 and after the developing section 1 (in downstream of the developing section 1 in a direction of rotation). Moreover, the image density sensor 60 measures the density of the patch image formed (developed) on the photoreceptor drum 3.

<Step S4>

Next, in cases where the γ correction (process carried out by developing density correcting means), which corrects one of or both of the developing bias of the developing section 1 and the potential charged on the photoreceptor drum 3, is carried out according to the image density of the patch image detected by the image density sensor 60 (that is, the density of the test image formed by using developing means), the control section 40 judges whether or not a correction amount is in a predetermined ordinary range (S4). For example, in cases where a patch image density is equal to or more than a predetermined maximal density, it is judged that the correction amount of the γ correction is less than the minimal correction amount of the ordinary range (the developing bias and the potential charged on the photoreceptor drum 3). On the other hand, in cases where the patch image density is less than a predetermined minimal density, it is judged that the correction amount of the γ correction is more than the maximal correction amount of the ordinary range.

Here, in cases where it is judged that the patch image density is not in the ordinary range, the next step is S5. In cases where it is judged that the patch image density is in the ordinary range, the next step is S21.

The ordinary range may be identical to a permissible range of the device, but it is preferable that the ordinary range be narrower than the permissible range so as to have some allowance.

<Step S5, Step S6>

In cases where it is judged that the correction amount of the γ correction is out of the ordinary range (one example of a predetermined range) in S4, the control section 40 changes (adjusts) a toner reference concentration used for controlling the toner supply, that is, the magnetic permeability reference value according to whether the correction amount is more than or less than the ordinary range (S5, one example of a process of magnetic permeability reference value adjusting means).

For example, in cases where the patch image density is equal to or more than the maximal density, the magnetic permeability reference value is increased as much as a predetermined correction level (that is, the toner reference concentration is decreased as much as a predetermined correction level). In contrast, in cases where the patch image density is less than the minimal density, the magnetic permeability reference value is decreased as much as a predetermined correction level (that is, the toner reference concentration is increased as much as a predetermined correction level). In this case, correcting the magnetic permeability detection value itself means practically the same as correcting the magnetic permeability reference value (although directions of the correction are opposite with each other).

Next, according to the magnetic permeability reference value whose setting is changed (adjusted) in S5, the setting of a γ correction TBL (table), which is the correction reference of the γ correction (correction of the developing density in developing density correction means), is changed (S6, one example of a process of developing density correction reference setting means).

The γ correction TBL is a conversion table which is used for converting the patch image density to the correction amount (hereinafter referred to as developing density correction amount) of the developing bias, the grid voltage, or the like (that is, for finding appropriate developing density correction amount for the patch image density).

In the present process, based on experimental data obtained under conditions of a plurality of the magnetic permeability reference values (that is, the toner concentration) (i) candidate γ correction TBLs, which are provided for the respective conditions, are stored in the data storage section 50 in advance, and (ii) an appropriate γ correction TBL for the magnetic permeability reference value which has been set to be changed is selected from the candidate γ correction TBLs. Needless to say, it is also possible to prepare only a standard γ correction TBL, and set correction coefficients according to the magnetic permeability reference value by predetermined correction formulas or the like.

<Step S7>

Further, according to the magnetic permeability reference value whose setting is changed (adjusted) in S5, or according to the γ correction TBL (one example of the correction reference of the developing density) whose setting is changed in S6, the control section 40 changes the timing (one example of a correction timing by developing density correcting means) for carrying out the γ correction (S7, one example of a process of developing density correction timing controlling means).

In the present embodiment, the γ correction is carried out in cases where the total number of printed sheets, which is counted (accumulated) in the below-mentioned print execution process and is stored in the data storage section 50, is equal to or more than the predetermined γ correction sheet number stored in the data storage section 50. Therefore, in the present process, the predetermined γ correction sheet number is changed. That is, in cases where the magnetic permeability reference value or the γ correction TBL is not in a normal setting (standard setting), the device is in such a state that it has a little allowance (margin) in its operation. Therefore, the predetermined γ correction sheet number is set to be less than standard number so that the γ correction is performed in a cycle (in a shorter interval).

<Step S8>

Next, after the processes of S5 to S7 (that is, according to the change in the magnetic permeability reference value by magnetic permeability reference value adjusting means), the control section 40 outputs a predetermined command to the developing section 1 (developing means), so as to cause the developing section 1 (developing means) to perform stirring of the developer (idling stirring without carrying out the development) in the developer tank 21 (one example of a process of stir controlling means).

In the ideal stirring, the stir rotating blade 22 and the stirring roller 23 rotate so as to stir the developer, which is expected to be in an unstable state in the developer tank 21. This stirring, however, stabilizes the developer in the developer tank 21 in an early stage.

The stirring continues, for example, for a predetermined period of time, or until a predetermined magnetic permeability detection value is obtained.

Moreover, in cases where the setting of the magnetic permeability reference value is so changed in S5 that the magnetic permeability reference value is lower than the earlier value, the toner supplying section 2 normally supplies the toner during the stirring of the developer.

<Step S21>

Meanwhile, in cases where it is judged that the correction amount of the γ correction is within the ordinary range (in the predetermined range) in S4, the control section 40 further judges whether or not the correction amount is in a range narrower than a predetermined range. When the control section 40 judges that the correction amount is not in the narrower range, the next step is S9. When the control section 40 judges that the correction amount is in the narrower range, the next is a process of Steps S22 to S25.

<Step S22, Step S23, Step S25>

In cases where the correction amount of the γ correction is judged to be in the narrower range in S21, backward processes by which the settings are returned to the normal setting are carried out. The backward processes are reversed processes of the processes in S5 to S7. That is, each of the magnetic permeability reference value (the toner reference concentration), the γ correction TBL, and the predetermined γ correction sheet number as a standard of the γ correction timing is returned to a normal setting value (S22: one example of process by magnetic permeability reference value adjusting means, S23: one example of process by developing density correction reference setting means, S24: one example of process by developing density correction reference setting means).

In this way, when an enough allowance in the correction amount of the γ correction is attained, each of the magnetic permeability reference value, the γ correction TBL, and the like is returned to a normal state, and thus normal developing density correction is carried out.

Also in this case, after the processes in S22 to S24 (that is, according to the change in the magnetic permeability reference value by magnetic permeability reference value adjusting means), the control section 40 controls the developing section 1 (developing means) to cause the developing section 1 to stir the developer in the developer tank 21 (one example of process by stir controlling means). After that, Step S9 is carried out.

<Step S9, Step S10, Step S11>

In cases where the stirring in S8 or the stirring in S25 is finished, or in cases where it is judged that there is no enough allowance in the correction amount of the γ correction (the correction amount of the γ correction is not small enough) in S21, the control section 40 functions so that, as in S2 and S3, the developing section 1 (developing means) forms (develops) a predetermined patch image (test image) again on the photoreceptor drum 3 (S9).

Next, the image density sensor 60 (image density detecting means) measures the patch image density (S10).

Further, based on the density of the patch image (test image) formed again by the developing section 1 (developing means), the control section 40 carries out the γ correction (developing density correction) by using the γ correction TBL (S11, one example of a process of developing density correcting means). This corrects one of or both of the developing bias of the developing section 1 (developing means) and the potential charged on the photoreceptor drum 3 (image carrier). As a result, the developing density is corrected.

Here, in cases where the magnetic permeability reference value is changed in S5 to be lower than the earlier value, that is, in case where the toner reference concentration is changed to be higher than the earlier value, the toner is supplied during the stirring in S8. Because of this, the toner concentration is higher than earlier. Thus, the patch image thus formed again has a higher density corresponding to the higher toner concentration. Therefore, the correction amount of the γ correction is in the ordinary range.

Meanwhile, in cases where the magnetic permeability reference value is changed in S5 to be higher than the earlier value, that is, in case where the toner reference concentration is changed to be lower than the earlier value, no adjustment is performed even though the stirring in S8 may change the electrical-charge amount of the developer, because it is impossible to carry out an adjustment of reducing the toner. Therefore, in many cases, the density of the patch image formed again does not differ vastly as compared with the density detected in S2 and S3. In such cases, the γ correction is carried out in such a manner that the correction amount is less than the lower limit of the ordinary range (or the correction amount is the lower limit of the ordinary range). However, as the toner is consumed by the execution of the print process, and the toner concentration goes down (that is, as the magnetic permeability detection value becomes close to the magnetic permeability reference value), it becomes possible to obtain an image with an appropriate density by the correction amount in the ordinary range. In other words, in this case, if the correction amount is maintained as it is, the developing density becomes too thick as the executing number of printed sheets in the print process increases. On this account, in cases where the magnetic permeability detection value is set in S5 to be higher than the earlier value (in cases where the toner reference concentration is set to be lower than the earlier value), it is preferable to set that the γ correction timing (predetermined γ correction sheet number) in S7 is scheduled to be earlier.

<Step S12, Step S13, Step S14>

Then, in cases where the γ correction (S11) is finished, or in cases where the control section 40 judges No to the γ correction timing in S1, the control section 40 repeats the print process (S14, image forming process) based on the print data received from the host device until all the pages are printed out (S12, S14). That is, the control section 40 functions in synchronism with the other devices so as to cause the developing section 1 to carry out the developing process of the electrostatic latent image on the photoreceptor drum 3. At this moment, the number of printed sheet (total number of the printed sheet) is counted, and the data storage section 50 stores the total number.

Then, in cases where the control section 40 judges Yes to the γ correction timing during printing, that is, in cases where the total number of printed sheets is equal to or more than the predetermined γ correction sheet number, the process return to S2 and repeats the above-mentioned process. Moreover, in cases where the printing is completed for all the pages, the present process is finished.

According to the above-mentioned processes, in the developing density correction based on the patch image density, normally, it is possible to correct the developing density in a short period of time by the correction (γ correction) of the developing bias and the grid voltage (the potential charged on the photoreceptor drum 3). Moreover, by combining the γ correction with the adjustment of the toner concentration (that is, the adjustment of the magnetic permeability reference value), it is possible to attain the developing density correction which has a wide correction range. Furthermore, in cases where the toner concentration (that is, the magnetic permeability reference value) is changed (adjusted), the setting of the γ correction TBL, which is the correction reference of the γ correction, is accordingly changed. Therefore, it is possible to assure the accuracy of the γ correction.

In addition, in cases where the magnetic permeability reference value or the γ correction TBL is changed from its normal setting, the cycle of the γ correction is shortened (the correction timing is scheduled to be earlier) by controlling the γ correction timing according to the magnetic permeability reference value, etc. Therefore, it is possible to judge early whether the state which allows to return to the normal setting is attained or not. As a result, the period of a state in which the ratio delay is little can be as short as possible.

Incidentally, in cases where the density (the density detected in S3) of the patch image outputted after the development in which the amount of the development is large (that is, in which the mount of the toner consumed is large), there is a possibility that the toner concentration around the developing roller 24 is partially low. That is, it is impossible to say that the density of the patch image outputted in such a state indicates a state of the device at that time accurately. Furthermore, if the development was further carried out in the state in which the toner concentration around the developing roller 24 is low, this would possibly lead to the transport of the carrier to the photoreceptor drum 3.

Then, in cases where it is estimated that the toner concentration around the developing roller 24 is low, it is an option to arrange such that the toner is supplied and stirred, for example, in Step S8 illustrated in FIG. 3, or in like step, no matter how the judgment is.

That is, in S8, no matter how the judgment is, the toner supplying section 2 (toner supplying means) supplies the toner, and the developing section 1 (developing means) stirs the developer, in cases where the density of the patch image is lower than the predetermined target density range and the development which consumes the toner equal to or more than a predetermined amount is carried out before the formation of the patch image. After the stirring is finished, the process proceeds to S9 and the patch image is formed again. After that, the γ correction (developing density correction) according to the density of the patch image formed again is carried out in Step S11 (one example of a process of developing density correcting means)(one example of a process of first test image formation controlling means).

In this way, the toner concentration is optimized and uniformized, and on the basis of this, the γ correction is carried out according to the patch image formed again with the developer of the toner concentration thus optimized and uniformized. Therefore, it is possible to carry out the developing density correction (γ correction) appropriately.

Note that, the amount of the toner consumed can be judged by, for example, a printing ratio (a ratio of an area in which an image is formed to an area available for development on a recording paper) of the development which is carried out just before forming the patch image in S2.

The following description explains properties of the magnetic permeability sensor 25.

FIG. 4(*a*) is a graph illustrating a relation between an elapsed time from a finish time of the last-time operation of the developing device X to a start time of this-time operation, that is, the stand time and the electrical-charge amount of the developer in the developer tank 21.

As illustrated in FIG. 4(*a*), as the stand time becomes long, the electrical-charge amount of the developer becomes low because of electrical discharge. This is an electrical discharge phenomenon, so that the electrical-charge amount decreases exponentially.

Moreover, FIG. 4(*b*) is a graph illustrating a relation between an elapsed time (operation elapsed time) from a start time of the operation which is started after the developing device X is let stand as it is (after the developing device X is continued to be in a non-operating state) and the electrical-charge amount of the developer.

When the operation starts, the developer is stirred (by driving the developing roller 24, the stirring roller 23, or the like). Therefore, as illustrated in FIG. 4(*b*), as the elapsed time from the start time of the operation becomes long, the electrical-charge amount of the developer increases exponentially.

Moreover, FIG. 5(*a*) is a graph illustrating a relation between the stand time of the developing device X (the elapsed time from the finish time of the last-time operation to the start time of this-time operation) and the detection value of the magnetic permeability sensor 25 (sensor output voltage, "sensor output" in the figures).

As illustrated in FIG. 5(*a*), as the stand time becomes long, the electrical-charge amount of the developer decreases exponentially (see FIG. 4(*a*)). Therefore, the detection value of the magnetic permeability sensor 25 (magnetic permeability detection value) increases exponentially. The reason for this is as follows: the repulsive force between particles of the developer decreases because of a decrease of the electrical-charge amount, so that a bulk density of the developer becomes high.

Here, in cases where the magnetic permeability detection value is V and the stand time is t, the magnetic permeability detection value V illustrated in FIG. 5(*a*) can be represented by the following formula (1) which is an exponential function using the stand time t as a variable:

$$V=V_0-V_h\cdot\{1-\exp(-t/\tau_d)\} \quad (1)$$

where $V_0$ is the magnetic permeability detection value when the developer is stable after it is let stand as it is for a long time, $V_h$ is the decreased width obtained by comparing the magnetic permeability detection value when the developer is adequately charged with the magnetic permeability detection value when the developer is stable after it is let stand as it is for a long time, and $\tau_d$ is a time constant of the electrical discharge. In case of the example in FIG. 5(*a*), $V_0=3$, $V_h=0.5$, and $\tau_d\approx 36$ (Hr).

Moreover, FIG. 5(*b*) is a graph illustrating a relation between the elapsed time (operation elapsed time) from the start time of the operation which is started after the developing device X is let stand as it is and the magnetic permeability detection value.

As mentioned above, as the elapsed time from the start time of the operation becomes long, the electrical-charge amount of the developer increases exponentially (see FIG. 4(*b*)). Therefore, contrary to the graph illustrated in FIG. 5(*a*), the detection value of the magnetic permeability sensor 25 decreases exponentially.

Here, in cases where the magnetic permeability detection value is V and the elapsed time from the start time of the operation of the developing device X is t, the magnetic permeability detection value V illustrated in FIG. 5(*b*) can be represented by the following formula (2) which is the exponential function using the operation elapsed time t as a variable:

$$V=V_0-V_h\cdot\{1-\exp(-t/\tau_c)\} \quad (2)$$

where $\tau_c$ is a time constant of the electrical discharge. In case of the example in FIG. 5(*b*), $V_0=3$, $V_h=0.5$, and $\tau_c\approx 5$ (min).

As is apparent from the above, it is not preferable that the patch image formation and the γ correction be carried out in a state where the developing device X starts the operation after it is let stand as it is for a long time.

Here, for example, it may be arranged as follows: before Step S1, between Step S4 and Step S5, or the like timing, (i) the stand time before this-time operation of the developing device X (that is, the elapsed time from the finish time of the last-time operation to the start time of this-time operation) is calculated by the control section 40, and (ii) in cases where the stand time calculated is longer than the predetermined reference time (predetermined time), the control section 40 causes the developing section 1 to stir the developer in the developer tank 21, and (iii) the control section 40 causes the developing section 1 to form the patch image (test image) (the process proceeds to S2). As a result, in S1, the control section 40 (developing density correcting means) performs the γ correction (developing density correction) according to the density of the patch image formed after the stirring is carried out (this the γ correction is one example of a process of second test image formation controlling means).

In this way, it is possible to avoid the patch image formation and the γ correction using the developer which is not adequately charged because of the electrical discharge during the stand time.

Moreover, FIG. 6(*a*) is a graph illustrating a relation between the humidity of the surrounding air and the detection value (output voltage) of the magnetic permeability sensor 25 in cases where the actual toner concentration of the developer is constant (4% by weight).

As illustrated in FIG. 6(*a*), in cases where the humidity of the surrounding air is high, the amount of the electrical discharge from the developer becomes large. Therefore, the electrical-charge amount of the developer decreases and the magnetic permeability detection value increases.

Moreover, FIG. 6(*b*) is a graph illustrating a relation between the actual toner concentration of the developer in the developer tank 21 and the detection value (magnetic permeability detection value) of the magnetic permeability sensor 25. In FIG. 6(*b*), the thick solid line represents a case of normal humidity. The chain line represents a case when the humidity is higher than the normal humidity. The dotted line represents a case when the humidity is lower than the normal humidity.

In cases where the humidity is fixed, the actual toner concentration and the magnetic permeability detection value (sensor output) are in proportion to each other in a negative direction (as the actual toner concentration increases, the magnetic permeability detection value (sensor output) decreases, and vice versa). However, even though the actual toner concentration is constant, the magnetic permeability detection value changes according to the change of the humidity.

Therefore, in cases where the magnetic permeability reference value is not set suitably according to the humidity, (i) when the humidity becomes high, the amount of the toner supplied is not enough, so that the actual toner concentration becomes lower than the target density, and (ii) when the humidity becomes low, the amount of the toner supplied is excess, so that the actual toner concentration becomes higher than the target density.

As is apparent from the above, it is not preferable that, in cases where the humidity changes largely, the patch image formation and the γ correction are carried out with disregard to the change of the humidity.

Here, for example, the control section 40 may be so arranged as to correct, before the Step S1 illustrated in FIG. 3, the magnetic permeability reference value according to the detection value (humidity of the surrounding air) of the humidity sensor 26 (one example of a process of humidity correction means).

Here, for example, it may be arranged that the setting of the correction width is carried out according to "a conversion table for converting from the humidity to the correction width of the magnetic permeability reference value" which is previously stored in the data storage section 50. The conversion table for converting to the correction width may be obtained by converting the vertical axis (magnetic permeability sensor output) of the graph of FIG. 6(*a*) into the correction width in the conversion table. In this case, correcting the magnetic permeability detection value itself means practically the same as correcting the magnetic permeability reference value.

In this way, it is possible to appropriately maintain the toner concentration of the binary developer according to the change of the humidity of the surrounding air. Furthermore, it is possible to appropriately adjust the developing density.

As above, the developing device of the present invention includes (a) the magnetic permeability detecting means for detecting magnetic permeability of developer containing toner and carriers in order to obtain a magnetic permeability detection value, (b) the toner supplying means for supplying the toner according to comparison of the magnetic permeability detection value and a magnetic permeability reference value, (c) the developing means for developing, by using the toner, an electrostatic latent image formed on an image carrier; and (d) the developing density correcting means for correcting a developing density by correcting, according to the density of a test image formed by using the developing means, a developing bias of the developing means and/or a potential charged on the image carrier, and the developing device further includes the magnetic permeability reference value adjusting means for adjusting the magnetic permeability reference value in cases where a correction amount by the developing density correcting means exceeds a predetermined range; and the developing density correction reference setting means for setting a correction reference of the developing density in the developing density correcting means according to the magnetic permeability reference value thus adjusted.

Therefore, in the developing density correction based on the test image density, normally, it is possible to correct the developing density in a short period of time by the correction (γ correction) of the developing bias and the grid voltage (the potential charged on the image carrier). Moreover, by combining the γ correction with the adjustment of the toner concentration (that is, the adjustment of the magnetic permeability reference value), it is possible to attain the developing density correction which has a wide correction range. Furthermore, in cases where the toner concentration (that is, the magnetic permeability reference value) is changed (adjusted), the setting of the correction reference (the conversion table, a conversion formula, etc. for conversion from the test image density to the correction amount) of the γ correction is accordingly changed. Therefore, it is possible to assure the accuracy of the γ correction.

When the magnetic permeability reference value or the correction reference of the developing density is not a normal value or is not a normal reference, the device is in such a state that it has a little allowance (margin) in its operation. Therefore, it is preferable that the state in which the ratio delay is little be solved as soon as possible (be changed to the normal state). For example, in cases where the toner concentration is decreased, the carriers in the developer tend to transit (lack) to the image carrier (photoreceptor) side. In cases where the toner concentration is increased, the toner which is not appropriately charged is increased, so that the toner tends to scatter.

Therefore, the development device may be so arranged as to include the developing density correction timing controlling means for controlling a correction timing of the developing density correcting means according to the magnetic permeability reference value or according to the correction reference of the developing density.

According to this, when the magnetic permeability reference value or the correction reference of the developing density is not a normal value or is adjusted from a normal reference, it is possible to judge early whether or not it is possible to return to the normal state by, for example, shortening the cycle of the γ correction (scheduling the correction timing to be performed earlier).

Moreover, the development device may be so arranged as to include the stir controlling means for causing the developing means to stir the developer according to the magnetic permeability reference value adjusted by the magnetic permeability reference value adjusting means.

In a state in which it is necessary to change the magnetic permeability reference value, it is expected that the developer in the developer tank is in an unstable state. The above means is provided for stirring and stabilizing the developer that is expected to be unstable.

Incidentally, in cases where the density of the test image outputted after the development in which the amount of the development is large (that is, in which the mount of the toner consumed is large) is low, there is a possibility that the toner concentration around the developing roller is partially low. That is, it is impossible to say that the density of the test image outputted in such a state indicates a state of the device at that time accurately. Furthermore, if the development was further carried out in the state in which the toner concentration around the developing roller is low, this would possibly lead to the transport of the carrier to the image carrier (photoreceptor drum).

Therefore, the development device may be so arranged as to include the first test image formation controlling means, wherein, in cases where the density of the test image is lower than a target density range and a development which consumes the toner not less than a predetermined amount is carried out before the test image is formed, the first test image formation controlling means causes the developing density correcting means to carry out the developing density correction according to the density of the test image formed again after the toner is supplied by the toner supplying means and the developer is stirred by the developing means and the test image is formed again.

Therefore, in cases where the density of the test image outputted after the development in which the mount of the toner consumed is large is low, the toner concentration is optimized and uniformized by replenishing the toner and stirring the developer, and on the basis of this, the test image is formed again. Then, the developing density adjustment is carried out according to the test image formed again with the developer of the toner concentration thus optimized and uniformized. Therefore, it is possible to carry out the developing density correction appropriately.

Here, the amount of the toner consumed can be judged by, for example, a printing ratio (a ratio of an area in which an image is formed to an area available for development on a recording paper) of the development which is carried out just before forming the test image.

Moreover, the development device may be so arranged as to include the second test image formation controlling means, wherein, in cases where an elapsed time from a finish time of the last-time operation of the developing device to a start time of this-time operation is longer than a predetermined time, the second test image formation controlling means causes the developing density correcting means to carry out the developing density correction according to the density of the test image after the developer is stirred by the developing means and the test image is formed.

In cases where the developing device is let stand as it is for a long time, the developer discharges the electricity. Because of the shortage of the electrical-charge amount, the measured value of the magnetic permeability is decreased. The reduction in the measured value gives false indication that the toner concentration is increased. If the formation of the test image and the developing density correction are carried out in this case, it is impossible to carry out the developing density adjustment appropriately in view of this, in cases where the stand time is long, the test image formation and the developing density correction are carried out after the developer is stirred so as to be charged adequately. In this way, it is possible to avoid the developing density correction using the developer which is not adequately charged.

Moreover, it is more preferable that the development device be so arranged as to include a humidity detecting means for detecting humidity of surrounding air; and a humidity correcting means for correcting the magnetic permeability reference value according to results detected by the humidity detecting means.

The developer changes the magnetic permeability detection value according to the change of the humidity of the surrounding air. Therefore, by correcting the magnetic permeability reference value according to the humidity, it is possible to appropriately maintain the toner concentration of the binary developer according to the change of the humidity of the surrounding air. Furthermore, it is possible to appropriately adjust the developing density.

Moreover, the present invention can be recognized as the developing density adjusting method corresponding to the process carried out by the developing device.

That is, the developing density adjusting method of the present invention includes the steps of (i) detecting magnetic permeability of developer containing toner and carriers in order to obtain a magnetic permeability detection value, (ii) supplying the toner according to comparison of the magnetic permeability detection value and a magnetic permeability reference value, (iii) developing, by using the toner, an electrostatic latent image formed on an image carrier, (iv) correcting a developing density of development in step (iii) according to the density of a test image, and the developing density adjusting method further includes the steps of (v) adjusting the magnetic permeability reference value according to a correction amount in step (iv), and (vi) adjusting a correction reference of the developing density in step (iv) according to the magnetic permeability reference value.

The embodiments and concrete examples of implementation discussed in the foregoing detailed explanation serve solely to illustrate the technical details of the present invention, which should not be narrowly interpreted within the limits of such embodiments and concrete examples, but rather may be applied in many variations within the spirit of the present invention, provided such variations do not exceed the scope of the patent claims set forth below.

What is claimed is:

1. A developing device, including (a) a magnetic permeability detecting section for measuring magnetic permeability of developer containing toner and carriers, in order to obtain a magnetic permeability detection value, (b) a toner supplying section for supplying the toner according to comparison of the magnetic permeability detection value and a magnetic permeability reference value, (c) a developing section for developing, by using the toner, an electrostatic latent image formed on an image carrier; and (d) a developing density correcting section for correcting a developing density by correcting, according to the density of a test image formed by using the developing section, a developing bias of the developing section and/or a potential charged on the image carrier, said developing device, comprising:

a magnetic permeability reference value adjusting section for adjusting the magnetic permeability reference value in cases where a correction amount by the developing density correcting section exceeds a predetermined ordinary range; and a developing density correction reference setting section for setting a correction reference of the developing density in the developing density correcting section according to the magnetic permeability reference value thus adjusted.

2. The developing device as set forth in claim 1, comprising:

a developing density correction timing controlling section for controlling a correction timing of the developing density correcting section according to the magnetic permeability reference value or according to the correction reference of the developing density.

3. The developing device as set forth in claim 1, comprising:

a stir controlling section for causing the developing section to stir the developer according to the magnetic permeability reference value adjusted by the magnetic permeability reference value adjusting section.

4. The developing device as set forth in claim 1, comprising a first test image formation controlling section, wherein, in cases where the density of the test image is lower than a target density range and a development which consumes the toner not less than a predetermined amount is carried out before the test image is formed, the first test image formation controlling section causes the developing density correcting section to carry out the developing density correction according to the density of the test image formed again after the toner is supplied by the toner supplying section and the developer is stirred by the developing section and the test image is formed again.

5. The developing device as set forth in claim 1, comprising a second test image formation controlling section, wherein, in cases where an elapsed time from a finish time of the last-time operation of the developing device to a start time of this-time operation is longer than a predetermined time, the second test image formation controlling section causes the developing density correcting section to carry out the developing density correction according to the density of the test image after the developer is stirred by the developing section and the test image is formed.

6. The developing device as set forth in claim 1, comprising:

a humidity detecting section for measuring humidity of surrounding air; and a humidity correcting section for correcting the magnetic permeability reference value according to results measured by the humidity detecting section.

7. The developing device as set forth in claim 1, wherein in cases where the correction amount by the developing density correction section is within the predetermined range, said developing density correction reference setting section resets the correction reference of the developing density in the developing density correcting section back to an original default value.

8. An image forming device using an electrophotographic printing method, the image forming device comprising a developing device, said developing device, including:

a magnetic permeability detecting section for measuring magnetic permeability of developer containing toner and carriers, in order to obtain a magnetic permeability detection value;

a toner supplying section for supplying the toner according to comparison of the magnetic permeability detection value and a magnetic permeability reference value;

a developing section for developing, by using the toner, an electrostatic latent image formed on an image carrier;

a developing density correcting section for correcting a developing density by correcting, according to the density of a test image formed by using the developing section, a developing bias of the developing section and/or a potential charged on the image carrier;

a magnetic permeability reference value adjusting section for adjusting the magnetic permeability reference value in cases where a correction amount by the developing density correcting section exceeds a predetermined ordinary range; and a developing density correction reference setting section for setting a correction reference of the developing density in the developing density correcting section according to the magnetic permeability reference value thus adjusted.

9. A developing density adjusting method, including the steps of:

(i) measuring magnetic permeability of developer containing toner and carriers, in order to obtain a magnetic permeability detection value, (ii) supplying the toner according to comparison of the magnetic permeability detection value and a magnetic permeability reference value, (iii) developing, by using the toner, an electrostatic latent image formed on an image carrier, (iv) correcting a developing density of development in step (iii) according to the density of a test image, said developing density adjusting method, comprising the steps of:

(v) adjusting the magnetic permeability reference value in cases where a correction amount in step (iv) exceeds a predetermined ordinary range, and (vi) adjusting a correction reference of the developing density in step (iv) according to the magnetic permeability reference value.

* * * * *